US009983493B2

(12) United States Patent
Nakatani et al.

(10) Patent No.: US 9,983,493 B2
(45) Date of Patent: May 29, 2018

(54) TONER FOR DEVELOPING ELECTROSTATIC IMAGES

(71) Applicant: ZEON CORPORATION, Tokyo (JP)

(72) Inventors: Hiroshi Nakatani, Tokyo (JP); Takeru Chiba, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days. days.

(21) Appl. No.: 14/779,481

(22) PCT Filed: Mar. 5, 2014

(86) PCT No.: PCT/JP2014/055596
§ 371 (c)(1),
(2) Date: Sep. 23, 2015

(87) PCT Pub. No.: WO2014/156521
PCT Pub. Date: Oct. 2, 2014

(65) Prior Publication Data

US 2016/0048089 A1 Feb. 18, 2016

(30) Foreign Application Priority Data

Mar. 25, 2013 (JP) ..... 2013-062556

(51) Int. Cl.
*G03G 9/08* (2006.01)
*G03G 9/097* (2006.01)

(52) U.S. Cl.
CPC ..... *G03G 9/0821* (2013.01); *G03G 9/0819* (2013.01); *G03G 9/09708* (2013.01); *G03G 9/09725* (2013.01); *G03G 9/09775* (2013.01); *G03G 9/09791* (2013.01)

(58) Field of Classification Search
CPC ..... G03G 9/0821; G03G 9/09716; G03G 9/09725; G03G 9/09791; G03G 9/09775; G03G 9/09708
See application file for complete search history.

(56) References Cited

U.S. PATENT DOCUMENTS 4,702,986 A * 10/1987 Imai ..... G03G 9/08704 430/108.6
6,287,739 B1 * 9/2001 Kawakami ..... G03G 9/0819 399/222
7,356,281 B2 * 4/2008 Miyakawa ..... G03G 9/08 399/111
2004/0146309 A1 7/2004 Shu et al.
2005/0048392 A1 3/2005 Tanaka
2005/0058924 A1 * 3/2005 Miyakawa ..... G03G 9/09708 430/108.6
2006/0063092 A1 3/2006 Hasegawa et al.
2006/0177754 A1 * 8/2006 Miyakawa ..... G03G 9/0804 430/108.6
2007/0099102 A1 5/2007 Ieda
2010/0203443 A1 * 8/2010 Okita ..... G03G 9/09708 430/108.7
2010/0261113 A1 * 10/2010 Aruga ..... G03G 9/0804 430/108.6
2012/0135344 A1 * 5/2012 Wada ..... G03G 9/0806 430/108.4

FOREIGN PATENT DOCUMENTS

JP 62-143061 A 6/1987
JP 3-231759 A 10/1991
JP 10-211440 A 8/1998
JP 11-95477 A 4/1999
JP 2001-5220 A 1/2001
JP 2002-214827 A 7/2002
JP 2002-365827 A 12/2002
JP 2003-029449 A 1/2003
JP 2003-43725 A 2/2003
JP 2003-131415 A 5/2003
JP 2004-078246 A 3/2004
JP 2004-258625 A 9/2004
JP 2005-070574 A 3/2005
JP 2005-164873 A 6/2005
JP 2006-72119 A 3/2006
JP 2006-085067 A 3/2006
JP 2007-121946 A 5/2007
(Continued)

OTHER PUBLICATIONS

Degussa Aerosil and Silanes. 31 pages. (no date).*
"Hexamethyldisilazane", Sigma Aldrich product listing. <<www.sigmaaldrich.com/catalog/product/aldrich/440191?lang=en &region=US#>>. Retrieved Jan. 19, 2018.*
"Special hydrophobic AEROSIL (SHA) for Toners" Nippon Aerosil Co, Ltd. Technical Information TI-1222. Aug. 2001.*
International Search Report dated Apr. 8, 2014, issued in counterpart Application No. PCT/JP2014/055596 (2 pages).
(Continued)

*Primary Examiner* — Christopher D Rodee
(74) *Attorney, Agent, or Firm* — Westerman, Hattori, Daniels & Adrian, LLP

(57) ABSTRACT

The present invention is to provide a toner which is able to inhibit the occurrence of fog, which is excellent in intermittent endurance, and which is excellent in followability during toner transfer and is thus excellent in top edge part uniformity in solid pattern printing. Disclosed is a toner for developing electrostatic images, comprising colored resin particles containing a binder resin, a colorant and a release agent, and an external additive, wherein static and kinetic friction coefficients obtained by measuring, using a 3-mm-diameter stainless-steel ball as a contactor, a 55-mm-diameter disk-shaped pellet obtained by pressing 4 g of the toner at 9 MPa for one minute, are 0.220 to 0.320 and 0.190 to 0.270, respectively, and a difference calculated by subtracting the kinetic friction coefficient from the static friction coefficient is 0.010 to 0.090.

6 Claims, No Drawings

(56) References Cited

FOREIGN PATENT DOCUMENTS

| | | | |
|---|---|---|---|
| JP | 2007-248867 | A | 9/2007 |
| JP | 2008-281625 | A | 11/2008 |
| JP | 2010-160204 | A | 7/2010 |

OTHER PUBLICATIONS

Notification of Transmittal of Translation of the International Preliminary Report on Patentability (Form PCT/IB/338) issued in counterpart Application No. PCT/JP2014/055596 dated Oct. 8, 2015, with Forms PCT/IB/373 and PCT/ISA/237 (8 pages).

* cited by examiner

TONER FOR DEVELOPING ELECTROSTATIC IMAGES

TECHNICAL FIELD

The present invention relates to a toner for developing electrostatic images, which can be used for development in image forming devices using electrophotography, such as a copy machine, a facsimile machine and a printer.

BACKGROUND ART

Conventionally, electrophotography is a method for obtaining a printed image in which a latent charge image is formed on a photosensitive member by various kinds of means using, in general, a photoconductive material; the latent image is developed by a toner and, as needed, the toner image is transferred onto a paper or the like; and the toner image is fixed by heating, pressing, solvent fume, etc., thereby obtaining a printed image.

Methods for developing latent charge images are broadly classified into liquid development methods, which use a developer in which various kinds of pigments or dyes and resins are finely dispersed in an insulating organic liquid, and dry development methods such as a cascade method, a magnetic brush method and a powder cloud method, which use a toner in which a colorant (e.g., carbon black) is dispersed in a natural or synthetic resin. In recent years, dry development methods are widely used from the viewpoint of ease of handling.

In electrophotography, due to its high energy efficiency, a heating roller method is widely and generally used for fixing. However, in such a thermal fixing method, there is such a problem that part of a toner image attaches to the surface of a heating roller upon fixing, transfers onto a copy paper and is likely to cause scumming (that is, a so-called toner offset phenomenon). To prevent the occurrence of the toner offset phenomenon, it is carried out to incorporate a release agent such as wax in a toner.

In the case of incorporating such a release agent in a toner, to prevent the occurrence of the toner offset phenomenon, it is preferable that the release agent is ideally present in the vicinity of the surface of toner particles. It is known that the release agent present in the vicinity of the surface decreases the friction coefficient of toner particles. It is also carried out to improve toner properties by appropriately controlling the friction coefficient.

For example, an image forming method is disclosed in Patent Literature 1, in which an electrostatic image is formed on an OPC photosensitive member having a specific surface hardness; the electrostatic image is developed with a toner to form a toner image, which is such a toner that a specific amount of polyalkylene is contained in a binder resin; the toner image is transferred onto a transferring material; and the toner image on the transferring material is fixed. It is also disclosed that the kinetic friction coefficient of the toner is 0.15 to 0.65. Color toners are disclosed in Patent Literature 2, each of which is composed of at least a binder resin, a colorant and an external additive, and it is also disclosed that there is a specific relationship between the kinetic friction coefficients of the color toners in four colors.

In Patent Literature 3, a toner composed of at least a binder resin and a release agent is disclosed, which is such a toner that the volume average particle diameter and the kinetic friction coefficient of the toner are set in specific ranges. In Patent Literatures 4 and 5, image forming methods using an image forming device having a specific processing speed are disclosed, in which the toner used for development contains a wax (release agent) and the kinetic friction coefficient of the toner is in a specific range.

CITATION LIST

Patent Literature Japanese Patent Application Laid-Open (JP-A) No. S62-143061
Patent Literature 2: JP-A No. 2001-5220
Patent Literature 3: JP-A No. 2006-85067
Patent Literature 4: JP-A No. 2003-43725
Patent Literature 5: JP-A No. 2005-164873

SUMMARY OF INVENTION

Technical Problem

In general, at the time of image formation, members such as a photosensitive member and a developing roller repeat moving and stopping. Especially, compared to the case of continuously printing a large number of papers, in the case of repeating the printing of a small number of papers many times, the repeat count increases. It has been found that the above-mentioned toner for which only the kinetic friction coefficient is defined, is insufficient in intermittent endurance that repeats moving and stopping.

An object of the present invention is to provide a toner which is able to inhibit the occurrence of fog, which is excellent in intermittent endurance and which is excellent in followability during toner transfer and is thus excellent in top edge part uniformity in solid pattern printing.

Solution to Problem

The inventors of the present invention have found that a toner which is excellent in the above-mentioned intermittent endurance and which is excellent in solid top edge part uniformity can be obtained by setting the static and kinetic friction coefficients of the toner in specific ranges and setting the difference between the friction coefficient at the beginning of a movement and the friction coefficient during the movement in a specific range.

According to the present invention, a toner for developing electrostatic images is provided, comprising colored resin particles containing a binder resin, a colorant and a release agent, and an external additive, wherein static and kinetic friction coefficients obtained by measuring, using a 3-mm-diameter stainless-steel ball as a contactor, a 55-mm-diameter disk-shaped pellet obtained by pressing 4 g of the toner at 9 MPa for one minute, are 0.220 to 0.320 and 0.190 to 0.270, respectively, and a difference calculated by subtracting the kinetic friction coefficient from the static friction coefficient is 0.010 to 0.090.

In the present invention, it is preferable that silica fine particles A having a number average primary particle diameter of 7 to 35 nm and silica fine particles B having a number average primary particle diameter of 36 to 200 nm are contained as the external additive.

In the present invention, it is preferable that alumina fine particles having a number average primary particle diameter of 5 to 400 nm are contained as the external additive.

In the present invention, it is preferable that fatty acid metal salt fine particles having a number average primary particle diameter of 0.05 to 5 μm are contained as the external additive.

In the present invention, it is preferable that an ester wax is contained as the release agent.

In the present invention, it is preferable that a fatty acid metal salt is contained as the release agent.

In the present invention, it is preferable that at least one hydrocarbon wax selected from the group consisting of polyethylene wax, polypropylene wax, Fischer-Tropsh wax, paraffin wax and microcrystalline wax is contained as the release agent.

It is preferable that the toner for developing electrostatic images according to the present invention has a volume average particle diameter of 7.8 to 8.8 μm.

Advantageous Effects of Invention

The above-mentioned toner for developing electrostatic images according to the present invention is such a toner that the static and kinetic friction coefficients of the toner and the difference between these friction coefficients are in specific ranges. Therefore, the toner thus provided is a toner which is excellent in intermittent endurance, which is excellent in solid top edge part uniformity, and which is less likely to cause fog.

DESCRIPTION OF EMBODIMENTS

The toner for developing electrostatic images according to the present invention comprises colored resin particles containing a binder resin, a colorant and a release agent, and an external additive, wherein static and kinetic friction coefficients obtained by measuring, using a 3-mm-diameter stainless-steel ball as a contactor, a 55-mm-diameter disk-shaped pellet obtained by pressing 4 g of the toner at 9 MPa for one minute, are 0.220 to 0.320 and 0.190 to 0.270, respectively, and a difference calculated by subtracting the kinetic friction coefficient from the static friction coefficient is 0.010 to 0.090.

Hereinafter, the toner for developing electrostatic images according to the present invention (hereinafter may be simply referred to as "toner") will be described.

The toner of the present invention contains colored resin particles containing a binder resin, a colorant and a release agent, and an external additive.

Hereinafter, the method for producing the colored resin particles used in the present invention, the colored resin particles obtained by the production method, the method for producing the toner of the present invention using the colored resin particles, and the toner of the present invention will be described in order.

1. Method for Producing Colored Resin Particles

Generally, methods for producing colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles of the present invention can be produced by employing the wet methods or the dry methods. The suspension polymerization method is preferable among the wet methods and is performed by the following processes.

(A) Suspension Polymerization Method (A-1) Preparation Process of Polymerizable Monomer Composition First, a polymerizable monomer, a colorant, a release agent, and other additives such as a charge control agent, which are added if required, are mixed to prepare a polymerizable monomer composition. For example, a media type dispersing machine is used for the mixing upon preparing the polymerizable monomer composition.

In the present invention, the polymerizable monomer means a monomer having a polymerizable functional group, and the polymerizable monomer is polymerizable into a binder resin. As a main component of the polymerizable monomer, a monovinyl monomer is preferably used. Examples of the monovinyl monomer include: styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and acrylic acid esters or methacrylic acid esters are suitably used for the monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids having a carbon-carbon double bond are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer to be used is generally 0.1 to 5 parts by mass, preferably 0.3 to 2 parts by mass, with respect to 100 parts by mass of the monovinyl monomer.

Further, it is preferable to use a macromonomer as a part of the polymerizable monomer, since the balance of the shelf stability and low-temperature fixability of the toner to be obtained can be improved. The macromonomer is a reactive oligomer or polymer having a polymerizable carbon-carbon unsaturated double bond at the end of a polymer chain and generally having a number average molecular mass of 1,000 to 30,000. A preferable macromonomer is one capable of providing a polymer having a higher glass transition temperature (hereinafter may be referred to as "Tg") than a polymer obtained by the polymerization of the monovinyl monomer.

The amount of the macromonomer to be used is preferably 0.03 to 5 parts by mass, more preferably 0.05 to 1 part by mass, with respect to 100 parts by mass of the monovinyl monomer.

In the present invention, a colorant is used. To produce a color toner, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used include compounds including azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269, and C. I. Pigment Violet 19.

In the present invention, these colorants can be used alone or in combination of two or more kinds. The amount of the colorant is preferably 1 to 10 parts by mass, with respect to 100 parts by mass of the monovinyl monomer.

From the viewpoint of improving the releasing characteristics of the toner from a fixing roller upon fixing, a release agent is added to the polymerizable monomer composition. The release agent is not particularly limited as long as it is one that is generally used as a release agent in toner.

The release agent preferably contains at least one of an ester wax, a hydrocarbon wax and a fatty acid metal salt. By using these waxes as the release agent, a suitable balance between low-temperature fixability and heat-resistant storage stability can be obtained. In addition, the static and kinetic friction coefficients can be controlled to be in the above specific ranges. Especially in the wet method, the release agent can be placed in the vicinity of the surface of colored resin particles to be obtained, using a phase separation in the polymer that will be toner particles. Therefore, the static and kinetic friction coefficients of the toner can be more easily controlled by the type or content of the release agent.

In the present invention, preferably used ester wax as the release agent is a polyfunctional ester wax. Examples thereof include: pentaerythritol ester compounds such as pentaerythritol tetrapalmitate, pentaerythritol tetrabehenate and pentaerythritol tetrastearate; glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate, and glycerin tribehenate; and dipentaerythritol ester compounds such as dipentaerythritol hexamyristate and dipentaerythritol hexapalmitate.

The amount of the ester wax to be used is preferably 2 to 10 parts by mass, more preferably 3 to 7 parts by mass, with respect to 100 parts by mass of the monovinyl monomer. As the content of the ester wax increases, the static and kinetic friction coefficients of the toner to be obtained tend to decrease.

The melting point of the ester wax is generally 50 to 90° C., preferably 60 to 85° C., more preferably 65 to 75° C.

Also in the present invention, preferably used as the release agent is a hydrocarbon wax. Examples thereof include: polyolefin waxes such as a polyethylene wax and a polypropylene wax; a Fischer-Tropsch wax; and petroleum waxes such as a paraffin wax and a microcrystalline wax. Of them, preferred are a Fischer-Tropsch wax and petroleum waxes, more preferred are petroleum waxes, and particularly preferred is a paraffin wax.

The hydrocarbon wax preferably has a number average molecular weight of 300 to 800, more preferably 400 to 600. The hydrocarbon wax preferably has a penetration of 1 to 10, more preferably 2 to 7, which is measured according to JIS K2235 5.4.

The amount of the hydrocarbon wax to be used is preferably 0.5 to 8 parts by mass, more preferably 1 to 5 parts by mass, with respect to 100 parts by mass of the monovinyl monomer. As the content of the hydrocarbon wax increases, the static and kinetic friction coefficients of the toner to be obtained tend to decrease. A change in the content of the hydrocarbon wax tends to have a larger impact on the kinetic friction coefficient of the toner, than on the static friction coefficient of the toner. The melting point of the hydrocarbon wax is generally 40 to 100° C., preferably 50 to 80° C., more preferably 60 to 75° C.

In the present invention, preferably used as the release agent is a fatty acid metal salt. The amount of the fatty acid metal salt to be used is preferably 0.01 to 2 parts by mass, more preferably 0.05 to 1 part by mass, with respect to 100 parts by mass of the monovinyl monomer. As the content of the fatty acid metal salt increases, the static and kinetic friction coefficients of the toner to be obtained tend to decrease. A change in the content of the fatty acid metal salt tends to have a larger impact on the static friction coefficient of the toner, than on the kinetic friction coefficient of the toner.

Examples of the metal constituting the fatty acid metal salt include Li, Na, K, Rb, Cs, Be, Mg, Ca, Sr, Ba and Zn.

The fatty acid (R—COOH) which corresponds to the fatty acid part ($R—COO^-$) of the fatty acid metal salt encompasses, of carboxylic acids having a carboxyl group (—COOH) (that is, R—COOH), all of those having a chain structure. In the present invention, the fatty acid part is preferably one derived from such a higher fatty acid that the alkyl group (R—) has a large carbon number.

Examples of the higher fatty acid (R—COOH) include lauric acid ($CH_3(CH_2)_{10}COOH$), tridecanoic acid ($CH_3(CH_2)_{11}COOH$), myristic acid ($CH_3(CH_2)_{12}COOH$), pentadecanoic acid ($CH_3(CH_2)_{13}COOH$), palmitic acid ($CH_3(CH_2)_{14}COOH$), heptadecanoic acid ($CH_3(CH_2)_{15}COOH$), stearic acid ($CH_3(CH_2)_{16}COOH$), arachidic acid ($CH_3(CH_2)_{18}COOH$), behenic acid ($CH_3(CH_2)_{20}COOH$) and lignoceric acid ($CH_3(CH_2)_{22}COOH$).

Typical concrete examples of the fatty acid metal salt include: metal laurates such as lithium laurate, sodium laurate, potassium laurate, magnesium laurate, calcium laurate and barium laurate; metal myristates such as lithium myristate, sodium myristate, potassium myristate, magnesium myristate, calcium myristate and barium myristate; metal palmitates such as lithium palmitate, sodium palmitate, potassium palmitate, magnesium palmitate, calcium palmitate and barium palmitate; and metal stearates such as lithium stearate, sodium stearate, potassium stearate, magnesium stearate, calcium stearate, barium stearate and zinc stearate. Of them, metal stearates are preferred, and zinc stearate is more preferred.

In the present invention, the fatty acid metal salt can be in a particulate form. The number average primary particle diameter of the fatty acid metal salt fine particles is generally 0.05 to 5 μm, preferably 0.1 to 3 μm, more preferably 0.3 to 2 μm.

As the fatty acid metal salt fine particles, various kinds of commercial products can be used. For example, there may be mentioned the following products manufactured by Sakai Chemical industry Co., Ltd.: SPL-100F (product name, lithium stearate, number average primary particle diameter 0.71 μm), SPX-100F (product name; magnesium stearate, number average primary particle diameter 0.72 μm), SPC-100F (product name, calcium stearate, number average primary particle diameter 0.51 μm) and SPZ-100F (product name, zinc stearate, number average primary particle diameter 0.5 μm).

Besides the above release agents, for example, there may be used a natural wax such as jojoba and a mineral wax such as ozokerite.

As the release agent, it is preferable to use the above-mentioned waxes alone or in combination of two or more kinds.

The total content of the release agent is preferably 0.1 to 30 parts by mass, more preferably 1 to 20 parts by mass, with respect to 100 parts by mass of the monovinyl monomer.

As another additive, to improve the charging ability of the toner, a charge control agent having positively charging ability or negatively charging ability can be used.

The charge control agent is not particularly limited, as long as it is one that is generally used as a charge control agent for toners. Among charge control agents, a charge control resin having positively charging ability or negatively charging ability is preferably used, since the charge control resin is highly compatible with the polymerizable monomer and can impart stable charging ability (charge stability) to the toner particles. From the viewpoint of obtaining a positively-chargeable toner, the charge control resin having positively charging ability is more preferably used. The toner of the present invention is preferably a positively-chargeable toner.

Examples of the charge control agent having positively charging ability include a nigrosine dye, a quaternary ammonium salt, a triaminotriphenylmethane compound, an imidazole compound, a polyamine resin preferably used as the charge control resin, a quaternary ammonium group-containing copolymer and a quaternary ammonium salt group-containing copolymer.

Examples of the charge control agent having negatively charging ability include: azo dyes containing metal such as Cr, Co, Al and Fe; metal salicylate compounds; metal alkylsalicylate compounds; and sulfonic acid group-containing copolymers, sulfonic acid salt group-containing copolymers, carboxylic acid group-containing copolymers and carboxylic acid salt group-containing copolymers, which are preferably used as the charge control resin.

In the present invention, it is desirable that the amount of the charge control agent to be used is generally 0.01 to 10 parts by mass, preferably 0.03 to 8 parts by mass, with respect to 100 parts by mass of the monovinyl monomer. When the added amount of the charge control agent is less than 0.01 part by mass, fog may occur. On the other hand, when the added amount of the charge control agent exceeds 10 parts by mass, printing soiling may occur.

As another additive, a molecular weight modifier is preferably used upon the polymerization of the polymerizable monomer which is polymerized into a binder resin.

The molecular weight modifier is not particularly limited, as long as it is one that is generally used as a molecular weight modifier for toners. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally 0.01 to parts by mass, preferably 0.1 to 5 parts by mass, with respect to 100 parts by mass of the monovinyl monomer.

(A-2) Suspension Process of Obtaining Suspension (Droplets Forming Process)

In the present invention, the polymerizable monomer composition containing at least a polymerizable monomer, a colorant and a release agent is dispersed in an aqueous medium containing a dispersion stabilizer, and a polymerization initiator is added therein. Then, the droplets of the polymerizable monomer composition are formed. The method for forming the droplets is not particularly limited. For example, the droplets are formed by means of a device capable of strong agitation, such as an (in-line type) emulsifying and dispersing machine (product name: MILDER; manufactured by: Pacific Machinery & Engineering Co., Ltd.) and a high-speed emulsifying and dispersing machine (product name: T. K. HOMOMIXER MARK II; manufactured by: PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-butylperoxydiethylacetate, hexylperoxy-2-ethylbutanoate, diisopropylperoxydicarbonate, di-t-butylperoxyisophthalate and t-butylperoxyisobutyrate. They can be used alone or in combination of two or more kinds. Among them, the organic peroxides are preferably used since they can reduce residual polymerizable monomer and can impart excellent printing durability.

Among the organic peroxides, preferred are peroxy esters, and more preferred are non-aromatic peroxy esters, i.e., peroxy esters having no aromatic ring, since they have excellent initiator efficiency and can reduce residual polymerizable monomer.

The polymerization initiator may be added after dispersing the polymerizable monomer composition into the aqueous medium and before forming droplets as described above, or may be added to the polymerizable monomer composition before the polymerizable monomer composition is dispersed into the aqueous medium.

The added amount of the polymerization initiator used for the polymerization of the polymerizable monomer composition, is preferably 0.1 to 20 parts by mass, more preferably 0.3 to 15 parts by mass, even more preferably 1 to 10 parts by mass, with respect to 100 parts by mass of the monovinyl monomer.

In the present invention, the aqueous medium means a medium containing water as a main component.

In the present invention, the dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron (II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used alone or in combination of two or more kinds.

Among the above dispersion stabilizers, colloids of inorganic compounds, particularly a colloid of a hardly water-soluble metal hydroxide, is preferable. By using a colloid of an inorganic compound, particularly a colloid of a hardly water-soluble metal hydroxide, the colored resin particles can have a small particle size distribution, and the amount of the dispersion stabilizer remaining after washing can be small, so that the toner thus obtained can clearly reproduce an image and has excellent environmental stability.

(A-3) Polymerization Process

Formation of the droplets is carried out as described under the above (A-2). The thus-obtained aqueous dispersion medium is heated to polymerize, thereby forming an aqueous dispersion of colored resin particles.

The polymerization temperature of the polymerizable monomer composition is preferably 50° C. or more, more preferably 60 to 95° C. The polymerization reaction time is preferably 1 to 20 hours, more preferably 2 to 15 hours.

The colored resin particles may be mixed with an external additive and used as a polymerized toner. It is preferable that the colored resin particles are so-called core-shell type (or "capsule type") colored resin particles obtained by using the colored resin particles as a core layer and forming a shell layer, which is a layer that is different from the core layer, around the core layer. The core-shell type colored resin particles can take a balance of lowering of fixing temperature and prevention of blocking at storage, since the core layer including a substance having a low softening point is covered with a substance having a higher softening point.

A method for producing the above-mentioned core-shell type colored resin particles using the colored resin particles is not particularly limited, and the core-shell type colored resin particles can be produced by any conventional method. The in situ polymerization method and the phase separation method are preferable from the viewpoint of production efficiency.

Hereinafter, a method for producing the core-shell type colored resin particles according to the in situ polymerization method will be described.

The core-shell type colored resin particles can be obtained by adding a polymerizable monomer for forming a shell layer (a polymerizable monomer for shell) and a polymerization initiator to an aqueous medium in which the colored resin particles are dispersed, and then polymerizing the mixture.

As the polymerizable monomer for shell, the above-mentioned polymerizable monomers can be used. Among the polymerizable monomers, it is preferable to use monomers which can provide a polymer having a Tg of more than 80° C., such as styrene, acrylonitrile and methyl methacrylate, alone or in combination of two or more kinds.

Examples of the polymerization initiator used for polymerization of the polymerizable monomer for shell include water-soluble polymerization initiators including: metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl)2-hydroxyethyl) propionamide). These polymerization initiators can be used alone or in combination of two or more kinds. The amount of the polymerization initiator is preferably 0.1 to 30 parts by mass, more preferably 1 to 20 parts by mass, with respect to 100 parts by mass of the polymerizable monomer for shell.

The polymerization temperature of the shell layer is preferably 50° C. or more, more preferably 60 to 95° C. The polymerization reaction time is preferably 1 to 20 hours, more preferably 2 to 15 hours.

(A-4) Processes of Washing, Filtering, Dehydrating and Drying

It is preferable that after the polymerization, the aqueous dispersion of the colored resin particles obtained by the polymerization is subjected to operations including filtering, washing for removing the dispersion stabilizer, dehydrating and drying several times as needed, according to any conventional method.

In the washing method, when the inorganic compound is used as the dispersion stabilizer, it is preferable to add acid or alkali to the aqueous dispersion of the colored resin particles, thereby dissolving the dispersion stabilizer in water and removing it. When the colloid of the hardly water-soluble inorganic hydroxide is used as the dispersion stabilizer, it is preferable to control the pH of the aqueous dispersion of the colored resin particles to 6.5 or less by adding acid. Examples of the acid to be added include inorganic acids such as sulfuric acid, hydrochloric acid and nitric acid, and organic acids such as formic acid and acetic acid. Particularly, sulfuric acid is suitable for its high removal efficiency and small impact on production facilities.

The methods for dehydrating and filtering are not particularly limited, and any of various known methods can be used. Examples of the filtration method include a centrifugal filtration method, a vacuum filtration method and a pressure filtration method. Also, the drying method is not particularly limited, and any of various methods can be used.

(B) Pulverization Method

In the case of producing the colored resin particles by employing the pulverization method, the colored resin particles are produced by the following processes.

First, a binder resin, a colorant, a release agent, and other additives such as a charge control agent, which are added if required, are mixed by means of a mixer such as a ball mill, a V type mixer, an FM Mixer (product name), a high-speed dissolver, an internal mixer or the like. Next, the thus-obtained mixture is kneaded while heating by means of a press kneader, a twin screw kneading machine, a roller or the like. The obtained kneaded product is coarsely pulverized by means of a pulverizer such as a hammer mill, a cutter mill or a roller mill, finely pulverized by means of a pulverizer such as a jet mill or a high-speed rotary pulverizer, and then classified into a desired particle diameter by means of a classifier such as a wind classifier or an airflow classifier, thereby obtaining the colored resin particles produced by the pulverization method.

In the pulverization method, those that are used under the above-mentioned "(A) Suspension polymerization method", that is, the binder resin, the colorant, the release agent, and the additives added if required, such as the charge control agent, can be used. Similarly to the colored resin particles obtained under the above "(A) Suspension polymerization method", the colored resin particles obtained by the pulverization method can be core-shell type colored resin particles by a method such as the in situ polymerization method.

As the binder resin, other resins which are conventionally and broadly used for toners can be used. Specific examples of the binder resin used in the pulverization method include polystyrene, styrene-butyl acrylate copolymers, polyester resins and epoxy resins.

2. Colored Resin Particles

The colored resin particles are obtained by the production method such as the above-mentioned "(A) Suspension polymerization method" or "(B) Pulverization method".

Hereinafter, the colored resin particles constituting the toner will be described. The below-mentioned colored resin particles encompass both core-shell type colored resin particles and colored resin particles which are not core-shell type.

The volume average particle diameter (Dv) of the colored resin particles is preferably 4 to 12 μm, more preferably 5 to 10 μm, even more preferably 7.8 to 8.8 μm, particularly preferably 7.9 to 8.7 μm, most preferably 8.0 to 8.6 μm. When the volume average particle diameter (Dv) of the colored resin particles is less than 4 μm, the flowability of the toner may lower and deteriorate transferability or decrease image density. When the volume average particle diameter (Dv) of the colored resin particles exceeds 12 μm, the resolution of images may decrease.

As for the colored resin particles, the ratio (Dv/Dn) of the volume average particle diameter (Dv) and the number average particle diameter (Dn) is preferably 1.0 to 1.3, more preferably 1.0 to 1.2. When the ratio Dv/Dn exceeds 1.3, there may be a decrease in transferability, image density and resolution. The volume average particle diameter and the number average particle diameter of the colored resin particles can be measured by a particle diameter measuring device (product name: Multisizer; manufactured by: Beckman Coulter, Inc.), for example.

The average circularity of the colored resin particles of the present invention is preferably 0.96 to 1.00, more preferably 0.97 to 1.00, even more preferably 0.98 to 1.00, from the viewpoint of image reproducibility.

When the average circularity of the colored resin particles is less than 0.96, thin line reproducibility may deteriorate.

In the present invention, "circularity" is defined as a value which is obtained by dividing the perimeter of a circle having the same area as the projected area of a particle image by the perimeter of the particle image. Also in the present invention, "average circularity" is used as a simple method for quantitatively describing the shape of the particles and is an indicator that shows the degree of the surface roughness of the colored resin particles. The average circularity is 1 when the colored resin particles are perfectly spherical, and it gets smaller as the surface shape of the colored resin particles becomes more complex.

3. Production Method of Toner

In the present invention, the colored resin particles and the external additive are mixed and agitated to cover the colored resin particles with the external additive and attach the external additive to the surface of the colored resin particles, thereby obtaining a one-component toner (developer). The one-component toner can be further mixed with carrier particles and agitated to obtain a two-component developer.

The agitator used to cover the colored resin particles with the external additive is not particularly limited, as long as it is an agitating device that is able to attach the external additive to the surface of the colored resin particles. For example, the colored resin particles can be covered with the external additive by using an agitator that is capable of mixing and agitation, such as FM Mixer (product name; manufactured by: Nippon Coke & Engineering Co., Ltd.), Super Mixer (product name; manufactured by: Kawata Manufacturing Co., Ltd.), Q Mixer (product name; manufactured by: Nippon Coke & Engineering Co., Ltd.), Mechanofusion System (product name; manufactured by: Hosokawa Micron Corporation) and Mechanomill (product name; manufactured by: Okada Seiko Co., Ltd.)

As the external additive, there may be mentioned: inorganic fine particles such as silica, titanium oxide, alumina, zinc oxide, tin oxide, calcium carbonate, calcium phosphate and cerium oxide, for example; organic fine particles such as polymethyl methacrylate resin, silicone resin and melamine resin, for example; and fatty acid metal salt particles. Of them, the inorganic fine particles are preferred. Of the inorganic fine particles, silica, alumina and/or titanium oxide is preferred, and it is particularly preferable to use fine particles of silica in combination with fine particles of alumina.

These external additives can be used alone or in combination of two or more kinds. It is particularly preferable to use two or more kinds of silica having different particle diameters.

In the present invention, it is desirable that the external additive is used in an amount of generally 0.05 to 6 parts by mass, preferably 0.2 to 5 parts by mass, with respect to 100 parts by mass of the colored resin particles. When the total added amount of the external additive is less than 0.05 part by mass, toner transferability may lower. When the total added amount of the external additive exceeds 6 parts by mass, fog may occur.

In the present invention, it is preferable that silica fine particles A having a number average primary particle diameter of 7 to 35 nm are contained as the external additive. When the number average primary particle diameter of the silica fine particles A is less than 7 nm, the silica fine particles A are likely to be transferred to the inside of the colored resin particles from the surface of the particles, so that the toner particles cannot be provided with sufficient flowability and there is a possible negative impact on printing performance. On the other hand, when the number average primary particle diameter of the silica fine particles A exceeds 35 nm, the ratio of the silica fine particles A to the surface of each toner particle (coverage) is decreased, so that the toner particles may not be provided with sufficient flowability.

The number average primary particle diameter of the silica fine particles A is more preferably 9 to 25 nm, even more preferably 11 to 20 nm.

The number average primary particle diameter of the external additive particles used in the present invention can be measured as follows, for example. First, the particle diameters of the external additive particles are measured by TEM, SEM or the like. The particle diameters of 30 or more of the external additive particles are measured in this manner, and the average is used as the number average primary particle diameter of the particles.

Other methods for measuring the number average primary particle diameter of the external additive particles used in the present invention, include the following method, for example: the external additive particles are dispersed in a dispersion medium such as water, and the dispersion is measured by a particle size analyzer (product name: MICROTRAC 3300EX II; manufactured by: Nikkiso Co., Ltd.) or the like, thereby measuring the number average primary particle diameter.

It is preferable that the silica fine particles A are hydrophobized particles. As the hydrophobizing agent, for example, there may be mentioned hydrophobizing agents such as a silane coupling agent, silicone oil, fatty acid and fatty acid metal salt. From the viewpoint of obtaining high image quality, a silane coupling agent and silicone oil are preferred.

Examples of the silane coupling agent include disilazanes such as hexamethyldisilazane; cyclic silazanes; alkylsilane compounds such as trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane and vinyltriacetoxysilane; and aminosilane compounds such as γ-aminopropyltriethoxysilane, γ-(2-aminoethyl)aminopropyitrimethoxysilane, γ-(2-aminoethyl)aminopropylmethyldimethoxysilane, aminosilane, N-(2-aminoethyl)3-aminopropyltrimethoxysilane and N-β-(N-vinylbenzylaminoethyl)-γ-aminopropyltrimethoxysilane.

Examples of the silicone oil include dimethylpolysiloxane, methylhydrogenpolysiloxane, methylphenylpolysiloxane and amino-modified silicone oil.

The hydrophobizing agent may be one kind or two or more kinds of the above.

In the case of obtaining a developer having positively charging ability, it is more preferable to use a silicon compound having an amino group, such as an aminosilane compound or amino-modified silicone oil, since a developer having excellent positively charging ability can be easily obtained.

The content of the silica fine particles A is preferably 0.1 to 1.2 parts by mass, more preferably 0.2 to 0.8 part by mass, with respect to 100 parts by mass of the colored resin particles.

When the content of the silica fine particles A is less than 0.1 part by mass, the function as the external additive cannot be sufficiently exerted and flowability may lower or shelf stability or durability may lower. On the other hand, when the content of the silica fine particles A exceeds 1.2 parts by mass, the silica fine particles A can be easily detached from the surface of the toner particles. Therefore, charging ability may lower in a high temperature and high humidity environment, and fog may occur.

Depending on the type or content of other external additives and other particle covering conditions, etc., as the content of the silica fine particles A increases, the static and kinetic friction coefficients of the toner to be obtained tend to decrease.

As the silica fine particles A, various kinds of commercial products can be used. Examples thereof include the following: HDK2150 (product name, number average primary particle diameter 12 nm) manufactured by Clariant Corp.; NA50Y (product name, number average primary particle diameter 35 nm), R504 (product name, number average primary particle diameter 12 nm), RA200HS (product name, number average primary particle diameter 12 nm) and RX300 (product name, number average primary particle diameter 7 nm), which are all manufactured by Nippon Aerosil Co., Ltd.; MSP-012 (product name, number average primary particle diameter 16 nm) and MSP-013 (product name, number average primary particle diameter 12 nm), which are both manufactured by Tayca Corporation; and TG-7120 (product name, number average primary particle diameter 20 nm) and TG-820F (product name, number average primary particle diameter 7 nm), which are both manufactured by Cabot Corporation.

In the present invention, it is preferable that silica fine particles B having a number average primary particle diameter of 36 to 200 nm are contained as the external additive.

When the number average primary particle diameter of the silica fine particles B is less than 36 nm, there is a decrease in spacer effect and printing performance is adversely affected, such as the occurrence of fog. On the other hand, when the number average primary particle diameter of the silica fine particles B exceeds 200 nm, the silica fine particles B can be easily detached from the surface of the toner particles. Therefore, the function as the external additive lowers and printing performance is adversely affected.

The number average primary particle diameter of the silica fine particles B is more preferably 40 to 150 nm, even more preferably 45 to 100 nm.

The content of the silica fine particles B is preferably 0.3 to 2.0 parts by mass, more preferably 0.6 to 1.4 parts by mass, with respect to 100 parts by mass of the colored resin particles.

When the content of the silica fine particles B is less than 0.3 part by mass, the function as the external additive cannot be sufficiently exerted and printing performance may be adversely affected. On the other hand, when the content of the silica fine particles B exceeds 2.0 parts by mass, the silica fine particles B can be easily detached from the surface of the toner particles. Therefore, the function as the external additive may lower, and printing performance may be adversely affected.

Depending on the type or content of other external additives and other particle covering conditions, etc., as the content of the silica fine particles B increases, the static and kinetic friction coefficients of the toner to be obtained tend to be decrease. It is also preferable that the silica fine particles B are hydrophobized particles. As the hydrophobizing agent, there may be used those that are mentioned above as the agents that can be used for the silica fine particles A.

As the silica fine particles B, various kinds of commercial products can be used. For example, there may be mentioned VPNA50H (product name, number average primary particle diameter 40 nm) manufactured by Nippon Aerosil Co., Ltd., and HDK H05TA (product name, number average primary particle diameter 50 nm) and HDK H05TX (product name, number average primary particle diameter 50 nm), which are both manufactured by Clariant Corp.

The toner of the present invention can contain either the silica fine particles A or the silica fine particles B. It is more preferable that the toner contains both the silica fine particles A and the silica fine particles B.

In the present invention, it is preferable that fatty acid metal salt fine particles having a number average primary particle diameter of 0.05 to 5 μm are contained as the external additive. When the number average primary particle diameter of the fatty acid metal salt fine particles is less than 0.05 μm, the charging ability of the toner may lower and fog may occur. On the other hand, when the number average primary particle diameter of the fatty acid metal salt fine particles exceeds 5 μm, white spots may occur in printed images.

The number average primary particle diameter of the fatty acid metal salt fine particles is preferably 0.1 to 3 μm, more preferably 0.3 to 2 μm.

The amount of the fatty acid metal salt fine particles which are suitably used as the external additive in the present invention, is preferably 0.01 to 1 part by mass, more preferably 0.03 to 0.3 part by mass, with respect to 100 parts by mass of the colored resin particles. As the content of the fatty acid metal salt fine particles as the external additive increases, the static and kinetic friction coefficients of the toner to be obtained tend to decrease. A change in the content of the fatty acid metal salt fine particles as the external additive tends to have a larger impact on the static friction coefficient of the toner, than on the kinetic friction coefficient of the toner.

Other details of the fatty acid metal salt fine particles are the same as those of the fatty acid metal salt used as the release agent under the above-mentioned "(A–1) Preparation process of polymerizable monomer composition".

In the present invention, it is preferable that alumina fine particles having a number average primary particle diameter of 5 to 400 nm are contained as the external additive. When the number average primary particle diameter of the alumina fine particles is less than 5 nm, the charge amount of the toner may remarkably decrease in a high temperature and high humidity (H/H) environment, and fog may occur. On the other hand, when the number average primary particle diameter of the alumina fine particles exceeds 400 nm, the charge amount of the toner may remarkably increase in a low temperature and low humidity (t/t) environment and fog may occur.

The number average primary particle diameter of the alumina fine particles is more preferably 30 to 200 nm, even more preferably 50 to 90 nm. Also, the alumina fine particles can be hydrophobized particles.

The content of the alumina fine particles is preferably 0.1 to 1.2 parts by mass, more preferably 0.3 to 0.9 part by mass, with respect to 100 parts by mass of the colored resin particles.

When the content of the alumina fine particles is less than 0.1 part by mass, the charge amount of the toner may remarkably increase in a low temperature and low humidity (L/L) environment, and fog may occur. On the other hand, when the content of the alumina fine particles exceeds 1.2 parts by mass, the charge amount of the toner may remarkably decrease in a high temperature and high humidity (H/H) environment, and fog may occur.

It is presumed that, the effect of homogenizing the charge amount of the toner is exerted when, although the detailed mechanism is not clear, the content of the alumina fine particles with respect to the colored resin particles is in the above range.

Depending on the type or content of other external additives and other particle covering conditions, as the content of the alumina fine particles increases, the static and kinetic friction coefficients of the toner to be obtained tend to decrease.

As the alumina fine particles, various kinds of commercial products can be used. For example, there may be mentioned AKP-G015 (product name, number average primary particle diameter 18 nm) manufactured by Sumitomo Chemical Company, Ltd., and AEROSIL Alu C (product name, number average primary particle diameter 65 nm) manufactured by Nippon Aerosil Co., Ltd.

As described for the above typical examples of the four kinds of external additives (silica fine particles A, silica fine particles B, fatty acid metal salt fine particles and alumina fine particles), the static and kinetic friction coefficients of the toner of the present invention can be controlled by the type or content of the external additives present on the toner surface.

4. Toner of the Present Invention

The toner of the present invention is a toner defined by static and kinetic friction coefficients measured by a specific friction test.

In the present invention, the specific friction test means a method of measuring, using a 3-mm-diameter stainless-steel ball as a contactor, a 55-mm-diameter disk-shaped pellet obtained by pressing 4 g of the toner of the present invention at 9 MPa for one minute. The measurement is preferably carried out under a so-called room temperature condition of a temperature of 15 to 30° C. and a measurement environment of a humidity of 0 to 30% RH. It is also preferable that the measurement rate is 0.1 to 2 mm/sec and the measurement distance is 1 to 20 mm. In the present invention, the measurement is carried out under an environment of a temperature of 23° C. and a humidity of 20% RH and conditions of a measurement rate of 0.5 mm/sec and a measurement distance of 5 mm. When the specific friction test is carried out on the toner of the present invention, for example, an automatic friction abrasion analyzer (product name: TS501; manufactured by: Kyowa interface Science Co., Ltd.) or the like can be used.

The toner of the present invention is such a toner that the static and kinetic friction coefficients measured by the specific friction test method are 0.220 to 0.320 and 0.190 to 0.270, respectively, and the difference calculated by subtracting the kinetic friction coefficient from the static friction coefficient is 0.010 to 0.090.

When the static friction coefficient of the toner is less than 0.220, filming is likely to occur, and fog due to poor charging is likely to occur. On the other hand, when the static friction coefficient of the toner exceeds 0.320, the friction coefficient is too high, so that the members (roller, blade, seal, OPC and so on) inside the used developing machine abrade quickly and result in a decrease in the printing durability of the toner.

The static friction coefficient of the toner is preferably 0.240 to 0.310, more preferably 0.260 to 0.310.

When the kinetic friction coefficient is less than 0.190, filming is likely to occur, and fog due to poor charging is likely to occur. On the other hand, when the kinetic friction coefficient exceeds 0.270, the friction coefficient of the toner is too high, so that the members (roller, blade, seal, OPC and so on) inside the used developing machine abrade quickly and result in a decrease in the printing durability of the toner.

The kinetic friction coefficient of the toner is preferably 0.200 to 0.250, more preferably 0.210 to 0.240.

It is presumed that the difference between the static friction coefficient and the kinetic friction coefficient relates to, upon the development of an electrostatic latent image using the toner, the frictional charge property of the toner at the beginning of a transition from a stopping state to a moving state and that of the toner in a subsequent stationary state. Therefore, it is considered that fog and solid top edge part uniformity can be excellent by setting the difference between the static friction coefficient and the kinetic friction coefficient in a specific range.

When the difference calculated by subtracting the kinetic friction coefficient from the static friction coefficient is less than 0.010, toner fogging is likely to occur, so that solid top edge part uniformity deteriorates. It is highly unlikely that the static friction coefficient is almost equal to the kinetic friction coefficient. When the difference calculated by subtracting the kinetic friction coefficient from the static friction coefficient exceeds 0.090, solid top edge part uniformity deteriorates.

The difference calculated by subtracting the kinetic friction coefficient from the static friction coefficient is preferably 0.020 to 0.075, more preferably 0.040 to 0.065.

The toner of the present invention having the above-mentioned static and kinetic friction coefficients, is a toner which is able to inhibit the occurrence of fog, which is excellent in intermittent endurance, and which is excellent in followability during toner transfer and is thus excellent in top edge part uniformity in solid pattern printing.

EXAMPLES

Hereinafter, the present invention will be described further in detail, with reference to examples and comparative examples. However, the scope of the present invention may not be limited to the following examples. Herein, "part(s)" and "I" are based on mass if not particularly mentioned.

Test methods used in the examples and the comparative examples are as follows.

1. Production of Toner for Developing Electrostatic Images

Example 1

First, 77 parts of styrene and 23 parts of n-butyl acrylate as monovinyl monomers, 7 parts of carbon black as a colorant, 0.7 part of divinylbenzene as crosslinkable monomer, 0.3 part of a polymethacrylic acid ester macromonomer (product name: AA6; manufactured by: TOAGOSEI Co., Ltd.; Tg: 94° C.) and 1 part of a charge control resin with positively charging ability (product name: FCA207P; manufactured by: Fujikura Kasei Co., Ltd.), 4 parts of hexaglycerin octabehenate (melting point 70° C.), 1 part of paraffin wax (manufactured by: Nippon Seiro Co., Ltd.; melting point: 66° C.) and 0.2 part of zinc stearate fine particles having a number average primary particle diameter of 0.5 am as release agents, and 1.2 parts of tetramethylthiuram disulfide as a molecular weight modifier, were dispersed at room temperature using a bead mill, thereby obtaining a uniformly mixed solution. With stirring the mixed solution, 5.2 parts of t-butylperoxy-2-ethylbutanoate was added thereto as a polymerization initiator. The stirring was continued until the mixture became uniform, thereby obtaining a polymerizable monomer composition.

Separately, in an agitation tank, an aqueous solution of 6.9 parts of sodium hydroxide (alkali metal hydroxide) dissolved in 50 parts of ion-exchanged water was gradually added to an aqueous solution of 9.8 parts of magnesium chloride (water-soluble polyvalent metal salt) dissolved in 250 parts of ion-exchanged water, while agitating at room temperature, to prepare a magnesium hydroxide colloid (hardly water-soluble metal hydroxide colloid) dispersion.

The polymerizable monomer composition was put in the above-obtained magnesium hydroxide colloid dispersion and dispersed at 12,000 rpm using an in-line type emulsifying and dispersing machine (product name: MILDER; manufactured by: Pacific Machinery & Engineering Co., Ltd.), thereby forming the droplets of the polymerizable monomer composition.

The suspension having the above-obtained droplets of the polymerizable monomer composition dispersed therein (a polymerizable monomer composition dispersion) was charged into a reactor furnished with an agitating blade, and the temperature thereof was raised to 90° C. to start a polymerization reaction. When the polymerization conversion rate reached almost 100%, 2 parts of methyl methacrylate (a polymerizable monomer for shell) and 0.1 part of 2,2'-azobis(2-methyl-N-(2-hydroxyethyl)-propionamide) (a water-soluble polymerization initiator for shell; product name: VA-086; manufactured by: Wako Pure Chemical Industries, Ltd.) dissolved in 20 parts of ion-exchanged water were put in the reactor. After maintaining and continuing the polymerization for 4 hours at 90° C., the reactor was cooled by water to stop the reaction, thereby obtaining an aqueous dispersion of colored resin particles.

The above-obtained aqueous dispersion of colored resin particles was subjected to acid washing in which, while agitating at room temperature, sulfuric acid was added dropwise until the pH of the aqueous dispersion was 6.5 or less. Then, the aqueous dispersion was subjected to filtration separation, and the thus-obtained solid was re-slurried with 500 parts of ion-exchanged water, and a water washing treatment (washing, filtration and dehydration) was carried out thereon several times. Next, filtration separation was carried out thereon, and the thus-obtained solid was placed in the container of a dryer and dried at 45° C. for 48 hours, thereby obtaining dried colored resin particles. The dried colored resin particles thus obtained has a volume average particle diameter (Dv) of 8.6 μm, a particle size distribution (Dv/Dn) of 1.23, and a sphericity of 1.18.

To 100 parts of the colored resin particles, 0.4 part of hydrophobized silica fine particles having a number average primary particle diameter of 12 nm as silica fine particles A, 1 part of hydrophobized silica fine particles having a number average primary particle diameter of 50 nm as silica fine particles B, 0.5 part of alumina fine particles having a number average primary particle diameter of 65 nm, and 0.05 part of zinc stearate fine particles having a number average primary particle diameter of 0.4 μm were added and mixed by means of a high-speed agitator (product name: FM Mixer; manufactured by: Nippon Coke & Engineering Co., Ltd.) to cover the colored resin particles with the silica, alumina and zinc stearate fine particles, thereby producing the toner for developing electrostatic images of Example 1.

Examples 2 to 6 and Comparative Examples 1 to 5

The toners for developing electrostatic images of Examples 2 to 6 and Comparative Examples 1 to 5 were produced in the same manner as Example 1, except that the added amounts of the colorants, release agents and external additives were changed as shown in Table 1. The properties of the thus-obtained toners for developing electrostatic images are shown in Table 1.

2. Evaluation of Properties of Colored Resin Particles and Toners

The properties of the toners of Examples to 6 and Comparative Examples 1 to 5 were examined. Also, the properties of the colored resin particles used in the toners were examined. Details are as follows.

(1) Particle Size Properties of Colored Resin Particles

The volume average particle diameter Dv, the number average particle diameter Dn and the particle size distribution Dv/Dn of the colored resin particles were measured with a particle diameter measuring device (product name: Multisizer; manufactured by: Beckman Coulter, Inc.) This measurement was carried out by the Multisizer in the following conditions:

Aperture diameter: 100 μm

Dispersion medium: Isoton II (product name)

Concentration: 10%

Number of measured particles: 100,000 particles

More specifically, 0.2 g of the colored resin particle sample was put in a beaker. An alkylbenzene sulfonic acid aqueous solution (product name: Driwel; manufactured by: Fujifilm Corporation) was added thereto, which serves as a dispersant. In addition, 2 mL of the dispersion medium was added to wet the colored resin particles. Then, 10 mL of the dispersion medium was added thereto, and the mixture was dispersed for one minute with an ultrasonic disperser and then measured by the above-mentioned particle diameter measuring device.

(2) Friction Coefficients of Toner

First, 4 g of the toner sample was put in a molding machine and pressed at a pressure of 9 MPa for one minute to produce a 55-mm-diameter disk-shaped pellet. The thus-obtained pellet was measured five times under an environment of a temperature of 23° C. and a humidity of 20% RH, using an automatic friction abrasion analyzer (product name: TS501; manufactured by: Kyowa Interface Science Co., Ltd.) in the following conditions. The average was calculated to obtain static and kinetic friction coefficients.

(Measurement Conditions)

Contactor: A point contactor (3-mm-diameter SUS ball) was used. Before the measurement, the contactor was subjected to ultrasonic washing with isopropanol and then dried for 5 minutes at a temperature of 90° C.

Measurement rate: 0.5 mm/sec

Measurement distance: 5 mm

Used fixture: Disk-shaped sample fixture

3. Printing Evaluation of Toner

Printing evaluation of the toners of Examples 1 to 6 and Comparative Examples 1 to 5 was carried out. Details are as follows.

(1) Initial Fog Test Under High Temperature and High Humidity (H/H) Environment

A commercially-available, non-magnetic one-component printer (printing rate: 20 sheets/min) and the toner to be evaluated were left to stand under a high temperature and high humidity (H/H) environment at a temperature of 35° C. and a humidity of 80% for one day. Then, fog was measured.

The color tone of a paper not subjected to printing was measured by a spectrometer and used as a reference value. Next, a white solid pattern was printed by the printer, using the toner to be measured. The color tones of any five parts of the white solid pattern were measured. Of the five color tones thus measured, the value whose difference with the reference value (ΔE) is the largest, was used as a fog value. As the fog value gets smaller, fog preferably decreases.

(2) Intermittent Endurance

The toner was put in the same printer as that used in the above "(1) Initial fog test under high temperature and high humidity (H/H) environment". The printer was left to stand for one day under a normal temperature and normal humidity (N/N) environment at a temperature of 23° C. and a humidity of 50%. Then, such a printing operation that printing of one sheet and stopping are alternately repeated at an image density of 4% (printing time: 3 sec/sheet; time interval between printing and printing: 9 seconds) was carried out. Image density and fog were measured every 500 sheets. Image density was obtained by measuring the sheet on which a solid pattern was printed, using a McBeth transmitting image densitometer. Fog was measured by the above-mentioned method.

As just described, the number of continuously printed sheets that could maintain such an image quality that the image density was 1.3 or more at the time of carrying out the above solid pattern printing, and the fog value was 1 or less at the time of carrying out the white solid pattern printing, was tested by printing up to 15,000 sheets. In Table 1, ">15000" shown in the column of the intermittent endurance test result indicates that the above-mentioned criteria was still met even after 15,000 sheets were continuously printed.

(3) Solid Top Edge Part Uniformity

In the above intermittent endurance test, solid pattern printing was carried out after printing 3,000 sheets. Using the above McBeth transmitting image densitometer, the image density of a part which is 10 mm apart from the top edge part of the solid pattern and the image density of the central part of the solid pattern were measured. Solid top edge part uniformity was evaluated from the difference between the image density of the top edge part and that of the central part.

The measurement and evaluation results of the toners for developing electrostatic images of Examples 1 to 6 and Comparative Examples 1 to 5 are shown in Table 1.

TABLE 1

| | | Example 1 | Example 2 | Example 3 | Example 4 | Example 5 | Example 6 | Comparative Example 1 | Comparative Example 2 | Comparative Example 3 | Comparative Example 4 | Comparative Example 5 |
|---|---|---|---|---|---|---|---|---|---|---|---|---|
| Colorant | Carbon black | 7 | 7 | 7 | 7 | 7 | — | 7 | 7 | 7 | 7 | 7 |
| | C.I. Pigment Yellow 93 | — | — | — | — | — | 5 | — | — | — | — | — |
| Release agent | Hexaglycerin octabehenate | 4 | 4 | 4 | 4 | 4 | 4 | — | 4 | 4 | 4 | 3 |
| | Dipentaerythritol hexamyristate | — | — | — | — | — | — | 6 | — | — | — | — |
| | Paraffin wax | 1 | — | — | 2 | 1 | 1 | — | 1 | 2 | 4 | 3 |
| | Zinc stearate | 0.2 | 1 | 0.2 | — | 0.2 | 0.2 | | 0.1 | 0.2 | 0.5 | — |
| External additive | Silica A | 0.4 | 0.4 | 0.4 | 0.2 | 0.4 | 0.4 | 0.4 | 0.4 | 0.4 | 0.2 | 0.4 |
| | Silica B | 1 | 1 | 1 | 1.2 | 1 | 1 | 1 | 1 | 1 | 0.8 | 1 |
| | Alumina | 0.5 | 0.5 | 0.8 | 0.3 | 0.5 | — | — | 0.8 | 0.8 | — | — |
| | Zinc stearate | 0.05 | 0.1 | 0.2 | 0.1 | — | 0.05 | — | 0.2 | 0. | 0.3 | — |
| | Calcium stearate | — | — | — | — | 0.5 | — | — | — | — | — | — |
| Toner properties | Static friction coefficient | 0.265 | 0.300 | 0.311 | 0.256 | 0.267 | 0.248 | 0.448 | 0.343 | 0.305 | 0.208 | 0.303 |
| | Kinetic friction coefficient | 0.211 | 0.240 | 0.232 | 0.203 | 0.215 | 0.232 | 0.428 | 0.255 | 0.201 | 0.188 | 0.287 |
| | Static friction coefficient-Kinetic friction coefficient | 0.054 | 0.060 | 0.079 | 0.053 | 0.052 | 0.016 | 0.020 | 0.088 | 0.104 | 0.020 | 0.016 |
| | Volume average particle diameter (μm) | 8.4 | 8.3 | 8.4 | 8.4 | 8.4 | 8.2 | 8.4 | 8.2 | 8.4 | 8.4 | 8.2 |
| Printing evaluation | Initial fog | 0.4 | 0.3 | 0.5 | 0.6 | 0.8 | 1.0 | 0.5 | 0.6 | 0.6 | 1.7 | 1.0 |
| | Intermittent endurance (sheets) | >15000 | >15000 | >15000 | 14500 | >15000 | 14000 | 11000 | 13000 | 15000 | 11000 | 12000 |
| | Solid top edge part uniformity | 0.03 | 0.04 | 0.15 | 0.06 | 0.03 | 0.13 | 0.11 | 0.24 | 0.22 | 0.15 | 0.12 |

4. Evaluation of Toners

Hereinafter, the evaluation results of the toners will be discussed, with reference to Table 1.

First, the toner of Comparative Example 1 will be discussed. According to Table 1, the toner of Comparative Example 1 has a static friction coefficient of 0.448 and a kinetic friction coefficient of 0.428, and the difference calculated by subtracting the kinetic friction coefficient from the static friction coefficient is 0.020.

According to Table 1, as for the toner of Comparative Example 1, the initial fog is 0.5 and the solid top edge part uniformity is 0.11. Therefore, as for the toner of Comparative Example 1, there is no problem with at least initial fog and solid top edge part uniformity.

However, as for the toner of Comparative Example 1, the number of sheets evaluated in the intermittent endurance test is as small as 11,000. This is the smallest number among the evaluated toners.

From the above results, it is clear that the toner of Comparative Example 1 having a static friction coefficient of more than 0.320 and a kinetic friction coefficient of more than 0.270 is poor in intermittent endurance. The reason is considered as follows. Both the static friction coefficient and the kinetic friction coefficient of the toner are too high; therefore, in such an environment that the toner repeats flowing and stopping, the endurance is decreased due to a friction between the toner particles or due to a friction between the toner and the members (such as roller).

Next, the toner of Comparative Example 2 will be discussed. According to Table 1, the toner of Comparative Example 2 has a static friction coefficient of 0.343 and a kinetic friction coefficient of 0.255, and the difference calculated by subtracting the kinetic friction coefficient from the static friction coefficient is 0.088.

According to Table 1, as for the toner of Comparative Example 2, the initial fog is 0.6. Therefore, as for the toner of Comparative Example 2, there is no problem with at least initial fog.

However, as for the toner of Comparative Example 2, the number of sheets evaluated in the intermittent endurance test is as small as 13,000, and the value of solid top edge part uniformity is as high as 0.24. Especially, the value of solid top edge part uniformity is the highest among the evaluated toners.

From the above results, it is clear that the toner of Comparative Example 2 having a static friction coefficient of more than 0.320 is poor in intermittent endurance and poor in solid top edge part uniformity. The reason is considered as follows. The static friction coefficient of the toner is too high; therefore, such a property of the toner that the toner uniformly distributes from the top end part to the inside of a solid image, that is, so-called followability of the toner, is decreased.

Next, the toner of Comparative Example 3 will be discussed. According to Table 1, the toner of Comparative Example 3 has a static friction coefficient of 0.305 and a kinetic friction coefficient of 0.201, and the difference calculated by subtracting the kinetic friction coefficient from the static friction coefficient is 0.104.

According to Table 1, as for the toner of Comparative Example 3, the initial fog is 0.6, and the number of sheets evaluated in the intermittent endurance test is 15,000. Therefore, as for the toner of Comparative Example 3, there is no problem with at least initial fog and intermittent endurance.

However, as for the toner of Comparative Example 3, the value of solid top edge part uniformity is as high as 0.22.

From the above results, it is clear that the toner of Comparative Example 3, whose difference calculated by subtracting the kinetic friction coefficient from the static friction coefficient is more than 0.090, is poor in solid top edge part uniformity. The reason is considered as follows. The difference between the static friction coefficient and the kinetic friction coefficient of the toner is too large; therefore, such a property of the toner that the toner uniformly distributes from the top end part to the inside of a solid image, that is, so-called followability of the toner, is decreased.

Next, the toner of Comparative Example 4 will be discussed. According to Table 1, the toner of Comparative Example 4 has a static friction coefficient of 0.208 and a kinetic friction coefficient of 0.188, and the difference calculated by subtracting the kinetic friction coefficient from the static friction coefficient is 0.020.

According to Table 1, as for the toner of Comparative Example 4, the value of solid top edge part uniformity is 0.15. Therefore, as for the toner of Comparative Example 4, there is no problem with at least solid top edge part uniformity.

However, as for the toner of Comparative Example 4, the initial fog is as high as 1.7, and the number of sheets evaluated in the intermittent endurance test is as small as 1,000. This initial fog value is the highest among the evaluated toners. Also, this number of sheets evaluated in the intermittent endurance test is the smallest among the evaluated toners.

From the above results, it is clear that the toner of Comparative Example 4 having a static friction coefficient of less than 0.220 and a kinetic friction coefficient of less than 0.190 is likely to cause initial fog and is poor in intermittent endurance. The reason is considered as follows. Both the static friction coefficient and the kinetic friction coefficient of the toner are too low; therefore, fog is likely to occur.

Next, the toner of Comparative Example 5 will be discussed. According to Table 1, the toner of Comparative Example 5 has a static friction coefficient of 0.303 and a kinetic friction coefficient of 0.287, and the difference calculated by subtracting the kinetic friction coefficient from the static friction coefficient is 0.016.

According to Table 1, as for the toner of Comparative Example 5, the initial fog is 1.0, and the value of solid top edge part uniformity is 0.12. Therefore, as for the toner of Comparative Example 5, there is no problem with at least initial value and solid top edge part uniformity.

However, as for the toner of Comparative Example 5, the number of sheets evaluated in the intermittent endurance test is as small as 12,000.

From the above results, it is clear that the toner of Comparative Example 5 having a kinetic friction coefficient of more than 0.270 is poor in intermittent endurance. The reason is considered as follows. The kinetic friction coefficient of the toner is too high; therefore, in such an environment that the toner repeats flowing and stopping, the endurance is decreased due to a friction between the toner particles or due to a friction between the toner and the members (such as roller).

Meanwhile, according to Table 1, as for the toners of Examples 1 to 6, the static friction coefficient is in the range from 0.248 to 0.311; the kinetic friction coefficient is in the range from 0.203 to 0.240; and the difference calculated by subtracting the kinetic friction coefficient from the static friction coefficient is in the range from 0.016 to 0.079.

According to Table 1, as for the toners of Examples 1 to 6, the initial fog is as low as 1.0 or less; the number of sheets evaluated in the intermittent endurance test is as large as 14,000 or more; and the value of solid top edge part uniformity is as low as 0.15 or less.

Therefore, it is clear that the toner of the present invention having a static friction coefficient of 0.220 to 0.320 and a kinetic friction coefficient of 0.190 to 0.270, which were measured by the above-mentioned specific method and whose difference calculated by subtracting the kinetic friction coefficient from the static friction coefficient is 0.010 to 0.090, is excellent in intermittent endurance, excellent in solid top edge part uniformity, and is less likely to cause initial fog.

The invention claimed is:

1. A toner for developing electrostatic images, comprising colored resin particles containing a binder resin, a colorant and a release agent, and an external additive, wherein static and kinetic friction coefficients obtained by measuring a 55-mm-diameter disk-shaped pellet obtained by pressing 4 g of the toner at 9 MPa for one minute, at a measurement temperature of 23° C., a measurement humidity of 20% RH, a measurement rate of 0.5 mm/sec, and a measurement distance of 5 mm using a 3-mm-diameter stainless-steel ball as a contactor, are 0.220 to 0.320 and 0.190 to 0.270, respectively, and a difference calculated by subtracting the kinetic friction coefficient from the static friction coefficient is 0.010 to 0.090;

wherein silica fine particles A having a number average primary particle diameter of 7 to 35 nm and silica fine particles B having a number average primary particle diameter of 36 to 200 nm are contained as the external additive;

wherein alumina fine particles having a number average primary particle diameter of 5 to 400 nm are contained as the external additive;

wherein the toner is a positively-chargeable toner; and wherein at least one of the silica fine particles A and the silica fine particles B is hydrophobized by a silicon compound having an amino group.

2. The toner for developing electrostatic images according to claim 1, wherein fatty acid metal salt fine particles having a number average primary particle diameter of 0.05 to 5 μm are contained as the external additive.

3. The toner for developing electrostatic images according to claim 1, wherein an ester wax is contained as the release agent.

4. The toner for developing electrostatic images according to claim 1, wherein a fatty acid metal salt is contained as the release agent.

5. The toner for developing electrostatic images according to claim 1, wherein at least one hydrocarbon wax selected from the group consisting of polyethylene wax, polypropylene wax, Fischer-Tropsh wax, paraffin wax and microcrystalline wax is contained as the release agent.

6. The toner for developing electrostatic images according to claim 1, wherein the toner has a volume average particle diameter of 7.8 to 8.8 μm.

* * * * *